US010783859B2

(12) United States Patent
May et al.

(10) Patent No.: US 10,783,859 B2
(45) Date of Patent: Sep. 22, 2020

(54) METHOD OF DRUMHEAD IMAGING

(75) Inventors: James H. May, Valencia, CA (US); Thomas Zygmont, Valley Glen, CA (US)

(73) Assignee: REMO, INC., Valencia, CA (US)

( * ) Notice: Subject to any disclaimer, the term of this patent is extended or adjusted under 35 U.S.C. 154(b) by 1749 days.

(21) Appl. No.: 13/136,641

(22) Filed: Aug. 8, 2011

(65) Prior Publication Data

US 2012/0175038 A1 Jul. 12, 2012

Related U.S. Application Data

(63) Continuation-in-part of application No. 12/929,269, filed on Jan. 12, 2011, now Pat. No. 8,148,619.

(51) Int. Cl.
*G10D 13/02* (2020.01)
*G10D 13/20* (2020.01)
(Continued)

(52) U.S. Cl.
CPC ..... *G10D 13/02* (2013.01); *B41M 1/40* (2013.01); *B41M 5/035* (2013.01); *D06P 5/003* (2013.01); *D06P 5/004* (2013.01); *G10D 13/20* (2020.02); *B41M 5/0256* (2013.01); *B41M 5/38242* (2013.01); *B41M 5/42* (2013.01); *B41M 5/52* (2013.01); *B41M 5/5218* (2013.01);
(Continued)

(58) Field of Classification Search
CPC .... B41M 1/40; B41M 5/035; B41M 5/38242; B41M 5/0256; B41M 5/52; B41M 5/42; B41M 7/0027; B41M 5/5218; B65H 2301/1321; B65H 2301/5111; B65H 2701/124; B65H 2701/19
USPC ..... 156/230, 247, 235
See application file for complete search history.

(56) References Cited

U.S. PATENT DOCUMENTS 3,444,732 A * 5/1969 McKinley et al. ..... 73/150 A
3,860,388 A * 1/1975 Haigh ..... 8/471
(Continued)

OTHER PUBLICATIONS http://www.fujipla-japan.com/goods/list.html—FUJIPLA 2006.*

*Primary Examiner* — Sonya M Sengupta
(74) *Attorney, Agent, or Firm* — Law Offices of Larry F. Gitlin; Larry F. Gitlin

(57) ABSTRACT

A method for forming a dye sublimation image in a vibrating membrane employed in a musical instrument comprising the steps of: providing an image, digitally prepared or otherwise, consisting of a simulated animal skin or another form of graphic; printing the image on a substrate employing a heat transfer ink dye; joining the substrate with the printed image with a sheet of a gas permeable membrane comprised of bi-axially oriented non-woven polyester fibers having a plurality of surface pores and vibrating and musical note producing capability; applying a combination of heat and pressure to the joined substrate with the printed image and the membrane to cause the individual surface pores to expand to enable the dye to gasify and permeate the surface pores to transfer the image; and, cooling the membrane to enable the surface pores to seal closed and encase the image within the surface of the membrane to protect against delamination and wear when the membrane vibrates which results from the intense and constant pounding of a drumstick, a mallet, a person's hand or some other rigid-like object.

11 Claims, 7 Drawing Sheets

(51) Int. Cl.

| | |
|---|---|
| ***B41M 5/035*** | (2006.01) |
| ***B41M 1/40*** | (2006.01) |
| ***B41M 5/382*** | (2006.01) |
| ***B41M 5/42*** | (2006.01) |
| ***B41M 5/025*** | (2006.01) |
| ***B41M 5/52*** | (2006.01) |
| ***D06P 5/28*** | (2006.01) |
| ***D06P 5/24*** | (2006.01) |

(52) U.S. Cl.

CPC ..... *B65H 2301/1321* (2013.01); *B65H 2301/5111* (2013.01); *B65H 2701/124* (2013.01); *B65H 2701/19* (2013.01)

(56) References Cited

U.S. PATENT DOCUMENTS

| | | | | |
|---|---|---|---|---|
| 5,716,900 | A * | 2/1998 | Kronzer et al. | 503/227 |
| 6,264,782 | B1 * | 7/2001 | Oshima et al. | 156/237 |
| 6,998,005 | B2 | 2/2006 | Magee et al. | |
| 6,998,213 | B2 | 2/2006 | Aso et al. | |
| 7,414,010 | B2 * | 8/2008 | Burrows | 503/227 |
| 2002/0105570 | A1 * | 8/2002 | Minowa | 347/102 |
| 2003/0007058 | A1 * | 1/2003 | Odamura | B41M 3/12 347/187 |
| 2003/0102078 | A1 | 6/2003 | Dabrowski et al. | |
| 2004/0213927 | A1 | 10/2004 | Ishida et al. | |
| 2005/0266204 | A1 * | 12/2005 | Abrams | 428/90 |
| 2006/0216497 | A1 * | 9/2006 | Torikoshi | G03G 7/0013 428/323 |
| 2006/0234015 | A1 | 10/2006 | Figueroa | |

* cited by examiner

METHOD OF DRUMHEAD IMAGING

This Application is a Continuation-in-Part of Prior application Ser. No. 12/929,269 filed Jan. 12, 2011 now U.S. Pat. No. 8,148,619.

BACKGROUND OF THE INVENTION

1. Field of the Invention

The present invention relates generally to the area of musical instruments. More particularly, the invention is directed to a method for forming a dye sublimation image of a simulated animal skin or some other graphic in a vibrating membrane employed in a musical instrument.

2. Description of the Prior Art

The use of graphic art on musical drumheads is well known in the prior art. Images on drumheads are used for all kinds of purposes, including, for example, simple aesthetics, to create a theme or personality for a musician or a band, or for general promotion. Examples of prior art graphic applications include silk screening, hand painting, stenciling or attaching the graphic born on a separate medium with adhesive. The dye sublimation process itself is also not new in the art, and has been used to apply a large assortment of graphic images of various colors and designs to drumheads of all kinds and sizes, including, without limitation, tom-toms, snares and bass drums.

Screened, stenciled or painted images are applied directly to the surface of the membrane and, thus, are inclined to peel or wear off over time due to the constant pounding of drumsticks, exposure to weather and other factors. The use of an adhesive backing introduces still another physical medium to the membrane, which tends to deaden its sound. With regard to all these applications, in addition to problems with delamination of the graphic from the substrate, the musical sound qualities and durability of the drumhead are severely undermined. Even with the dye sublimation process, there are instances when the application of a graphic image to a drumhead membrane, though aesthetically appealing, will produce a sound of inferior quality due to the inferiority of or other problems associated with the process itself. This concern is especially high in regard to drumheads used for timpani drums and for ethnic drums, including, for example, congas, bongos, Djembes and Doumbeks, which in the past have used heads made from actual animal skins. Synthetic drumheads then replaced the animal skins to improve the longevity of the heads, which resisted moisture brought about by changing climate and other weather conditions. The ability to apply a graphic to a drumhead, particularly one that so realistically simulates a genuine animal skin, and maintain and even enhance the quality of the synthetic drumhead sounds in the process is just another important benefit of the technology of the present invention. Nevertheless, except for some small, though important, advances in the art involving the use of simulated animal skins or other kinds of graphics with synthetic heads, nothing, until now, has succeeded in achieving a method for producing a synthetic drumhead with the superior musical sound qualities and the delamination and wear resistant properties of the present invention. The present invention results in a significantly superior dye sublimation imaging method for drumhead membranes than heretofore were unattainable in the prior art.

SUMMARY OF THE INVENTION

The present invention provides a method for forming a dye sublimation image in a vibrating membrane employed in a musical instrument comprising the steps of: providing an image, digitally prepared or otherwise, consisting of a simulated animal skin or another form of graphic; printing the image on a substrate employing a heat transfer ink dye; joining the substrate with the printed image with a sheet of a gas permeable membrane comprised of bi-axially oriented non-woven polyester fibers having a plurality of surface pores and vibrating and musical note producing capability; applying a combination of heat and pressure to the joined substrate with the printed image and the membrane to cause the individual surface pores to expand to enable the dye to gasify and permeate the surface pores to transfer the image; and, cooling the membrane to enable the surface pores to seal closed and encase the image within the surface of the membrane to protect against delamination and wear when the membrane vibrates which results from the intense and constant pounding of a drumstick, a mallet, a person's hand or some other rigid-like object.

Accordingly, it is an object of the present invention to provide an improved method to more effectively and permanently form a dye sublimation image within a vibrating membrane employed in a musical instrument.

It is another object of the present invention to provide an improved method to more effectively and permanently form a dye sublimation image within a vibrating membrane employed in a musical instrument comprised of bi-axially oriented non-woven polyester fibers having a plurality of surface pores and a vibrating and musical note producing capability.

Another object of the present invention is to provide an improved method to more effectively and permanently form a dye sublimation image within a vibrating membrane that can resist normal delamination and wear when constantly pounded by a rigid object.

A further object of the present invention is to provide an improved method to more effectively and permanently form a dye sublimation image within a vibrating membrane that enhances the tonal qualities produced by a musical instrument.

A still further object of the present invention is to provide an improved method to more effectively and permanently form a dye sublimation image within a vibrating membrane that enhances the visual qualities of the musical instrument.

A still further object of the present invention is to provide an improved method to more effectively and permanently form a dye sublimation image within a vibrating membrane that produces the image of an authentic animal skin.

A still further object of the present invention is to provide an improved method to more effectively and permanently form a dye sublimation image within a vibrating membrane that enables the mass production of a variety of musical drumheads with integrated dye sublimation images.

Yet another object of the present invention is to provide an improved method to more effectively and permanently form a dye sublimation image within a vibrating membrane that is easy and cost effective to use.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

The present invention will be described in more detail with reference to the preferred embodiment shown in FIGS. 1 through 6.

Figure 1:
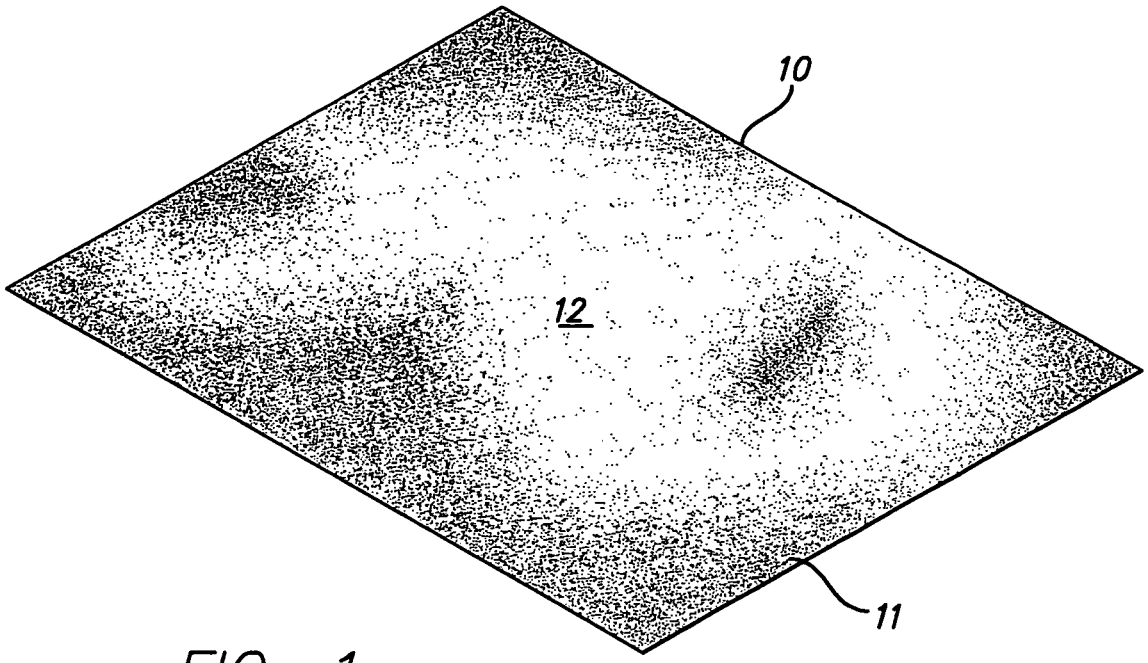
FIG. 1 is a perspective view of a transfer substrate with a printed graphic of a simulated animal skin in accordance with the method of the present invention.

FIG. 1 is a perspective view of a transfer substrate 10 typically comprised of a standard presentation grade paper or any other suitable medium. A desired image 12, such as a simulated animal skin or some other type of graphic, is prepared using any conventional electronic or mechanical method or means. Employing a computer-based method, for example, the computer instructs a printer to print a digital image 12 onto the transfer substrate 10, in this example standard presentation grade paper, using standard dye-sublimation or heat transfer inks 11. The paper onto which image 12 is transferred simply acts as a carrier for the inked image, which is eventually transferred to another, more permanent substrate 14, usually consisting of polyester, as described below.

Polyester is comprised of long chain polymers chemically composed of an ester, a dihydric alcohol, and a terephthalic acid. The family of polyesters include, among a variety of chemical materials, linear, light molecular weight thermoplastics, such as polyethylene terephthalate (PET).

Woven polyester, PET or otherwise, requires continuous filaments or fibers, which are converted into fabric using looms or knitting machines to produce, for example, a variety of apparel products.

In contrast, non-woven polyester materials are typically manufactured by combining fibers in the form of a sheet or web and then bonding these fibers together, either mechanically, chemically or thermally. Because these materials are not made by weaving or knitting, there is no need to convert the fibers to yarn, as required with the process used to produce woven materials.

Woven fabric contains filaments or fibers oriented typically in one direction, generally in parallel relation. In contrast, non-woven fabric or film of the plastic kind, for example, is bi-axially oriented with the placement of filaments generally normal to one another.

One of the most common, if not the predominant, material used to manufacture the modern day synthetic drumhead is polyethylene terephthalate film, which is an extruded and bi-axially oriented version of PET fiber which, for example, DuPont™ sells under the well-known trademark MYLAR™.

Again, with reference to the preferred embodiment of the present invention, transfer substrate 10 and permanent substrate 14 are joined and then exposed concurrently to heat between 250 and 394 degrees Fahrenheit and pressure between 20 and 100 PSI for a period of 30 seconds to 3 minutes. Variance in the temperature, pressure and time depend on the material composition of the substrates.

Figure 2A:
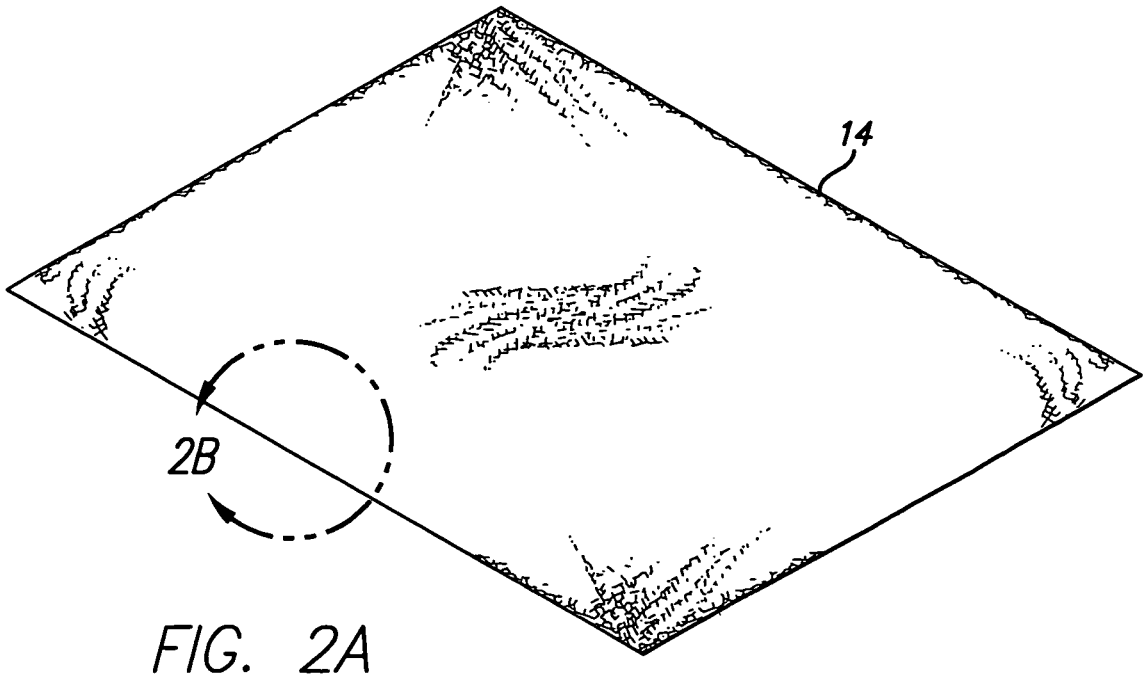
FIG. 2A is a perspective view of the membrane substrate in accordance with the method of the present invention.
Figure 2B:
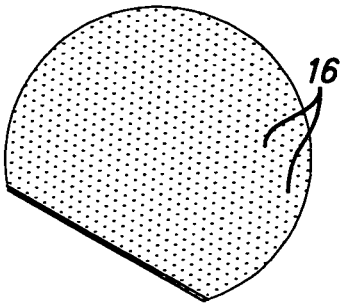
FIG. 2B is a cross-section of the membrane substrate with closed surface pores as shown and defined by circular line 2B in FIG. 2A.
Figure 2C:
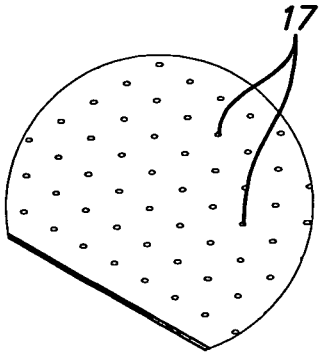
FIG. 2C is a cross-section of a version of the membrane substrate shown and defined by circular line 2B in FIG. 2A with open surface pores.

FIGS. 2B and 2C are cross-sections of substrate 14 shown in FIG. 2A. FIG. 2B shows multiple closed surface pores 16 in substrate 14 before heat 18 is applied and the image transfer process begins. FIG. 2C shows multiple open surface pores 17, but open prepared to receive the transfer of image 12 from transfer substrate 10.

Figure 3:
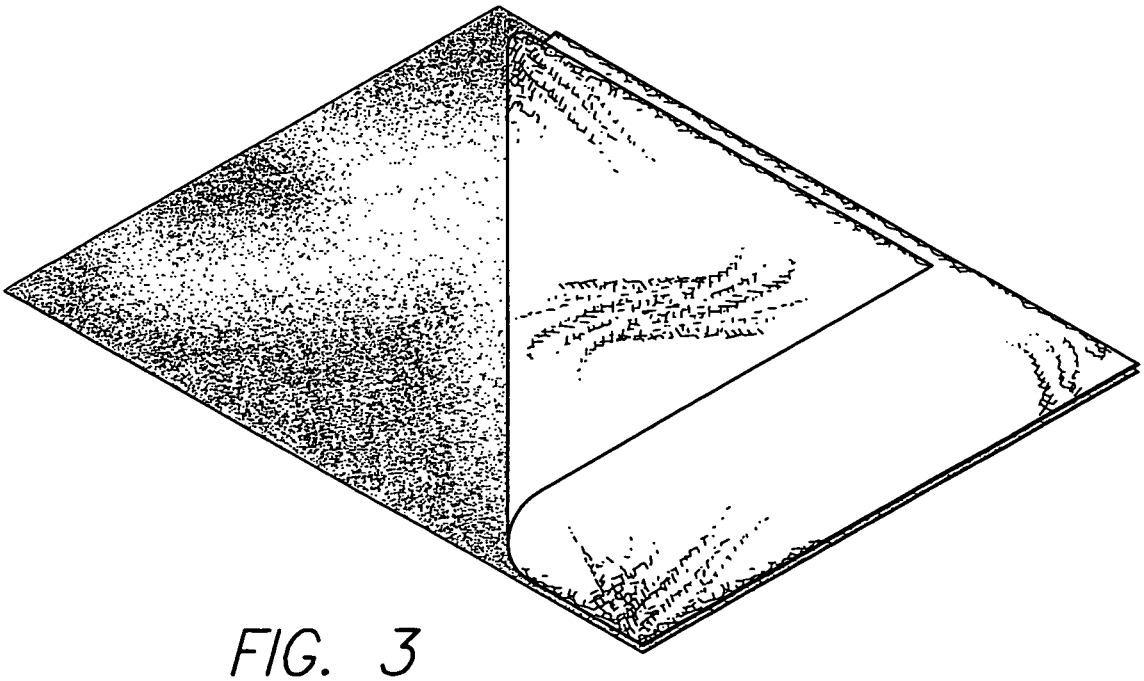
FIG. 3 is a perspective view of the transfer substrate with the graphic image (bottom) being covered by the membrane substrate in accordance with the method of the present invention.

FIG. 3 shows transfer substrate 10 with printed graphic image 12 on the bottom with permanent substrate 14, again, with this embodiment a polyester film membrane, being laid over the top.

Figure 4A:
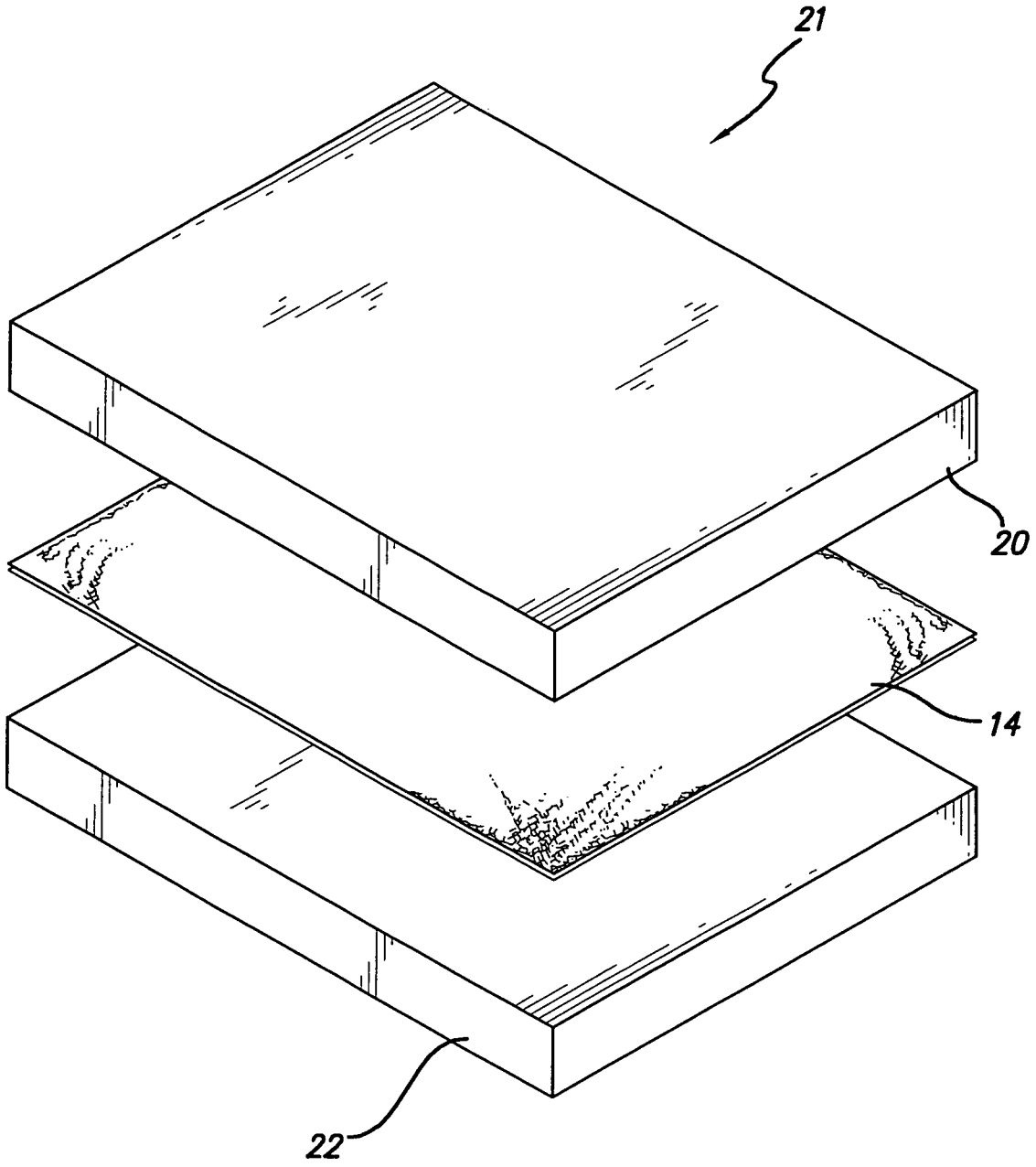
FIG. 4A is a perspective view of the press and heating apparatus consisting of top and bottom platen and conforming substrates in between for performing the method according to the present invention.
Figure 4B:
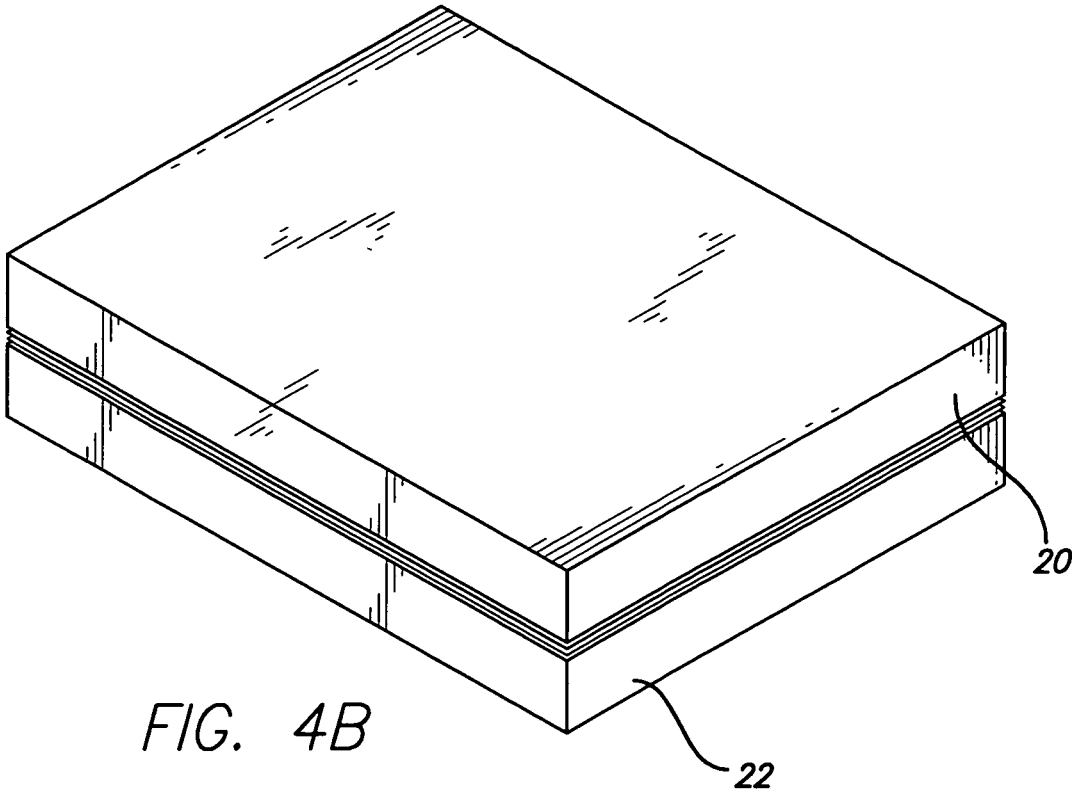
FIG. 4B is a perspective view of the apparatus consisting of top and bottom platen pressing the conforming substrates in between for performing the method of the present invention.
Figure 5A:
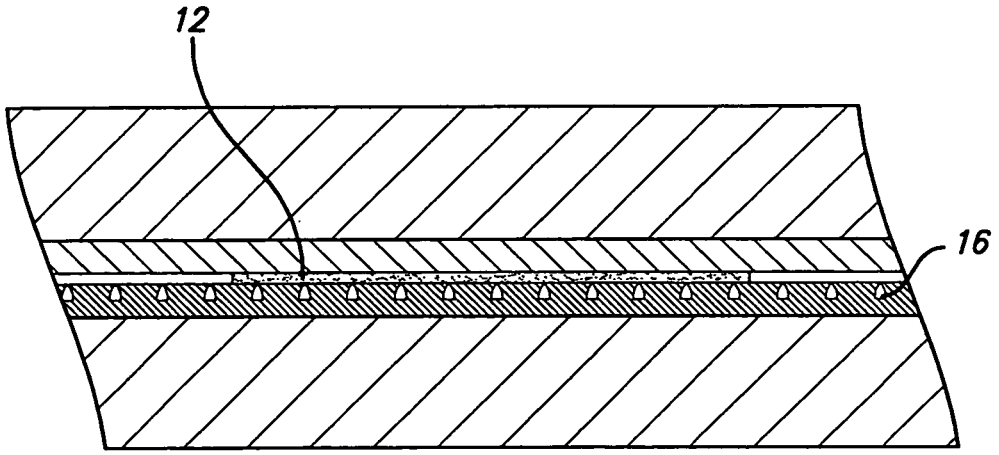
FIG. 5A is a cross-sectional view of the apparatus and substrates shown in FIG. 4B for performing the method of the present invention.
Figure 5B:
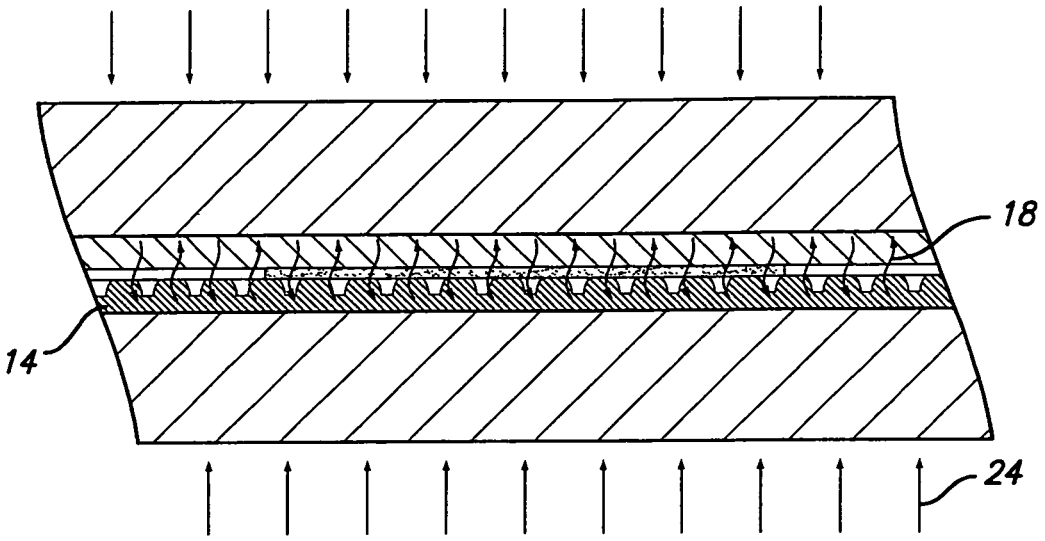
FIG. 5B is a cross-sectional view of another embodiment of the apparatus and substrates shown in FIG. 4B used for performing a further step of the method of the present invention.
Figure 5C:
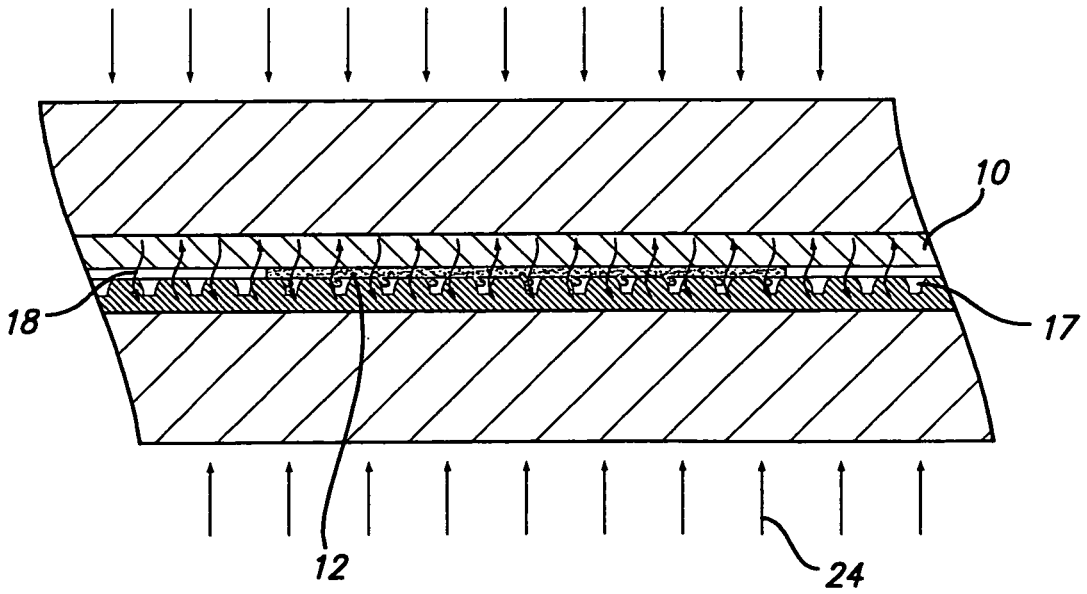
FIG. 5C is a cross-sectional view of another embodiment of the apparatus and substrates shown in FIG. 4B used for performing a further step of the method of the present invention.
Figure 5D:
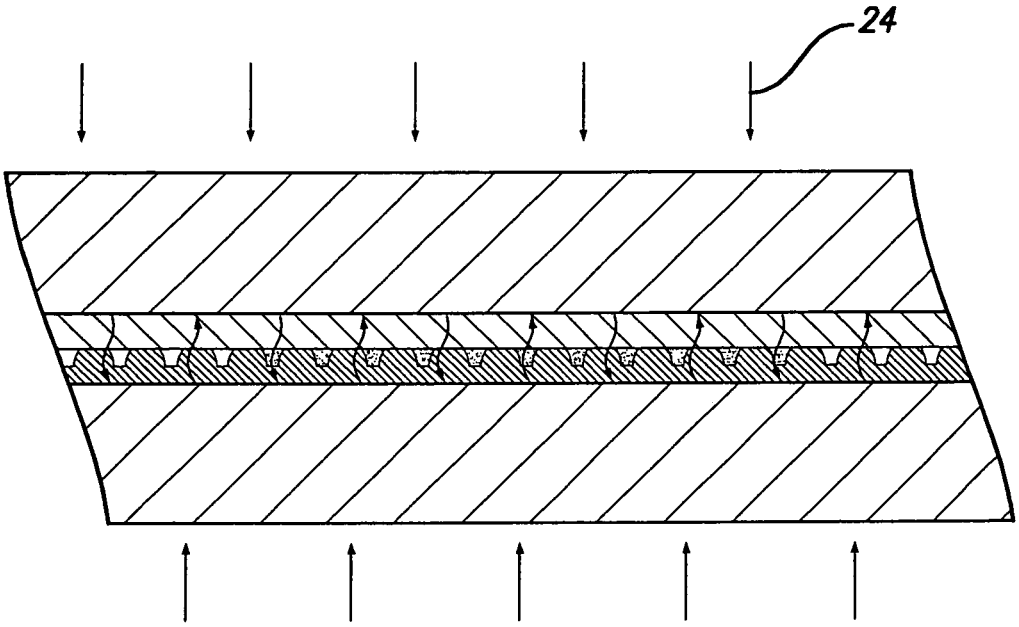
FIG. 5D is a cross-sectional view of another embodiment of the apparatus and substrates shown in FIG. 4B used for performing a further step of the method of the present invention.
Figure 5E:
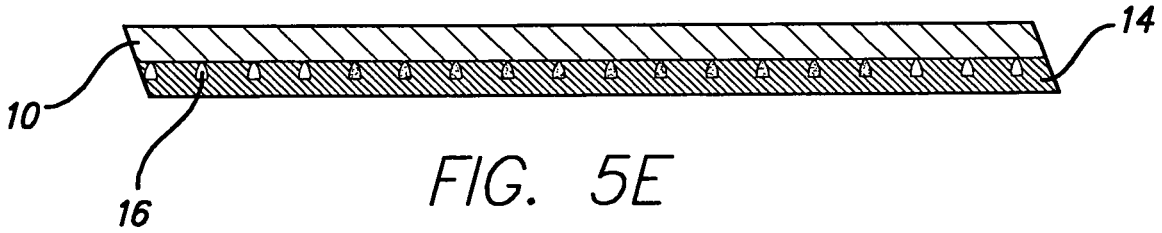
FIG. 5E is a cross-sectional view of another embodiment of the substrates shown in FIG. 4B used for performing a further step of the method of the present invention.
Figure 5F:
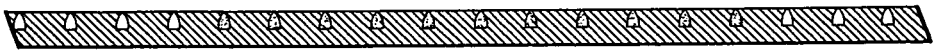
FIG. 5F is a perspective view of the membrane substrate with integrated encased image in accordance with the method of the present invention.

FIG. 4A shows the preferred embodiment of apparatus 21 used for performing the method of the present invention. Shown are two rectangular platen, including top platen 20 and bottom platen 22, and the joined substrates 10 and 14 in between. An appropriate press apparatus (not shown) is used to cause platen 20 and platen 22 to converge and apply the necessary pressure 24 to joined substrates 10 and 14 (FIG. 4B). A heat source using any conventional means (also not shown) compels the transfer of heat 18 through platen 20 and platen 22 into substrates 10 and 14 to cause closed surface pores 16 in substrate 14 to open allowing ink 11 from printed image 12 in substrate 10 to permeate (FIGS. 5A-5E). Heat 18, along with required pressure 24, is sufficiently intense to permit ink 11 to bypass a liquid state and gasify instead. With sufficient pressure, ink 11 permeates open surface pores 17 in substrate 14 and then open surface pores 17 are fused. When the transfer of image 12 is complete, substrate 14 with the integrated transferred image is allowed to cool permitting, in turn, now closed surface pores 16 within substrate 14 to cure and permanently encase image 12 (FIG. 5F). This ensures that image 12, despite the amount and intensity of the pounding it receives when the drumhead membrane is struck, is delamination and weather resistant.

Figure 6:
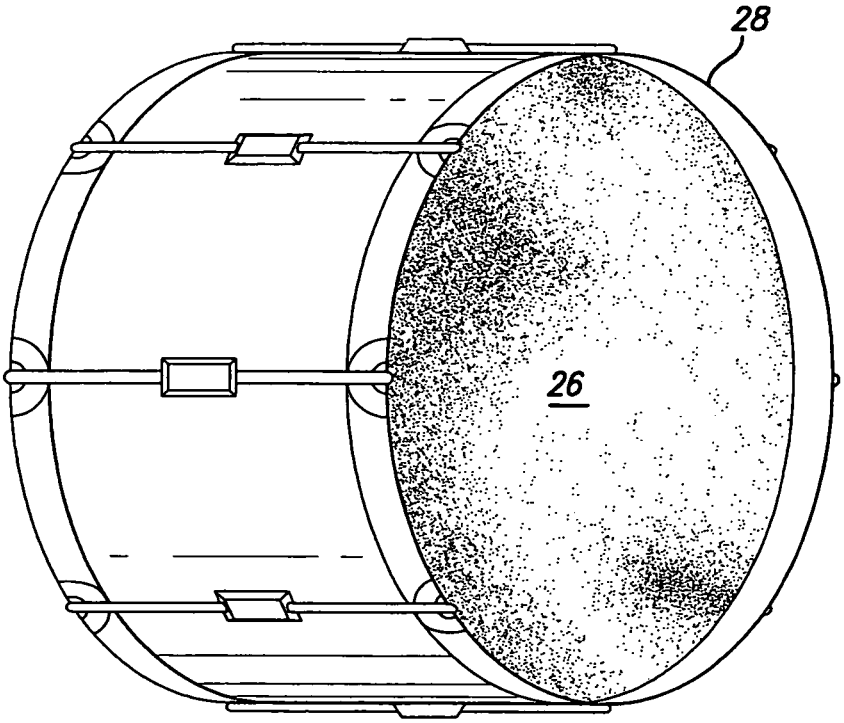
FIG. 6 is a perspective view of a transferred image of a simulated animal skin on a bass drum produced in accordance with the method of the present invention.

FIG. 6 is an example of imbued image 12 within the vibrating membrane or head 26 of a bass drum 28.

Other alternatives available for performing the method of the present invention include the use of heated and pinch rollers (not shown) similar to a steam press or a lamination machine in lieu of platen 20 and platen 22 described herein.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A method for forming a dye sublimation image comprising the steps of:

providing an image;

providing a substrate;

transferring said image onto said substrate;

providing a sheet of gas permeable membrane with vibrational character comprised of bi-axially oriented non-woven polyester fibers for use in the fabrication of a musical drumhead, said sheet of gas permeable membrane having a plurality of surface pores and a musical drum sound producing capability;

joining said image enhanced substrate with said sheet of gas permeable membrane;

applying a combination of heat and pressure to said joined said image enhanced substrate and said sheet of gas permeable membrane to cause said individual surface pores to expand to enable said dye to gasify and permeate said surface pores to transfer said image; and, cooling said membrane to enable said surface pores to seal over and encase said image to integrate said image with said membrane in delamination and weather resistant relation.

2. The method of claim 1, including the step of joining said first substrate and said printed image with a sheet of a gas permeable membrane comprised of polyethylene terephthalate film.

3. The method of claim 2 including the step of providing a first platen and a second platen for applying a combination of heat within a temperature range of 250° to 394° Fahrenheit and a pressure range of 20 PSI and 100 PSI to said joined first substrate and said sheet of polyester material.

4. The method of claim 2 including the step of providing a roller means for applying a combination of heat and pressure to said joined first substrate and said sheet of polyester material.

5. The method of claim 1 including the step of providing an image comprised of a simulated animal skin.

6. The method of claim 1 including the step of providing an image comprised of graphic art.

7. The method of claim 1 including the step of providing a first substrate comprised of a paper material.

8. The method of claim 1 including the step of providing a first substrate comprised of a polyester material.

9. The method of claim 1 including the step of providing a first substrate comprised of synthetic material.

10. The method of claim 1 including the step of providing an image that is digitally prepared.

11. The method of claim 3 including the step of providing said combination of heat and pressure for a period ranging between 30 and 180 seconds.

* * * * *